United States Patent [19]

Morris

[11] 4,036,385

[45] July 19, 1977

[54] SAFETY CLOSURE FOR CONTAINERS

[76] Inventor: Glenn H. Morris, 4203 Highwood Drive, Chattanooga, Tenn. 37415

[21] Appl. No.: 690,962

[22] Filed: May 28, 1976

[51] Int. Cl.[2] ..... B65D 55/02; B65D 85/56; A61J 1/00

[52] U.S. Cl. ..... 215/209; 215/216; 215/221

[58] Field of Search ..... 215/209, 216, 221

[56] References Cited

U.S. PATENT DOCUMENTS

| | | | |
|---|---|---|---|
| 3,902,620 | 9/1975 | McIntosh | 215/209 |
| 3,958,709 | 5/1976 | Nixdorff | 215/216 |

*Primary Examiner*—George T. Hall
*Attorney, Agent, or Firm*—Brady, O'Boyle & Gates

[57] ABSTRACT

A threaded container cap has locking teeth on a bottom skirt portion thereof which cooperate with a tooth carried by a yielding release element on the side wall of the container body portion. Separation of the interlocked teeth is caused by lateral pressure on the release element of the container body portion substantially normal to the container axis.

14 Claims, 16 Drawing Figures

FIG.3
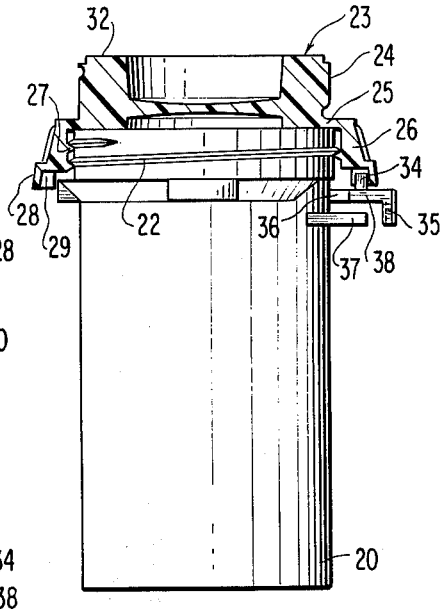
FIG.2
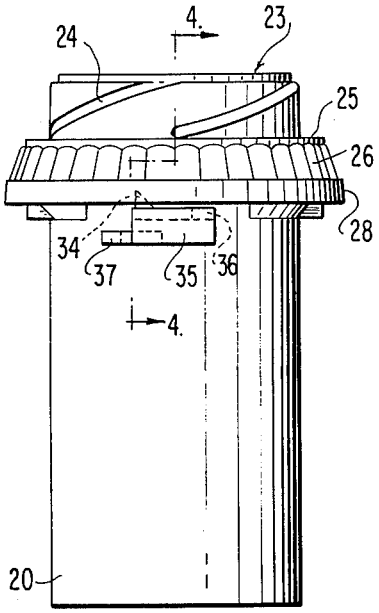
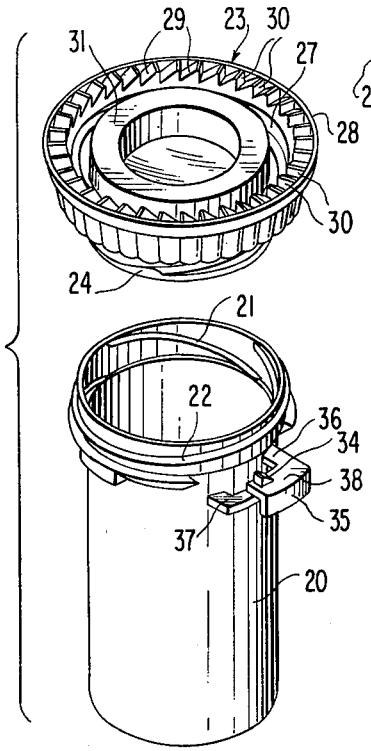
FIG.1
FIG.4
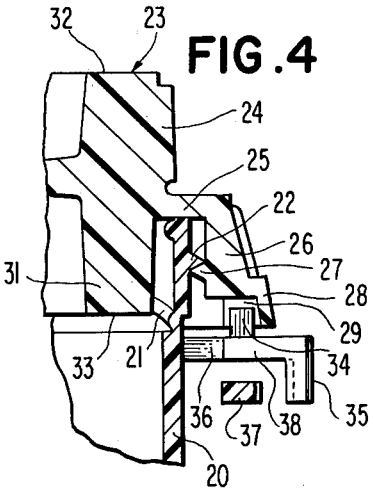
FIG.5
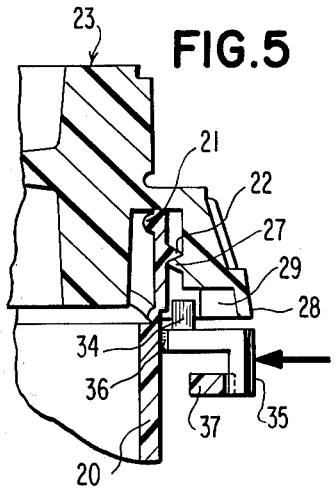
FIG.6
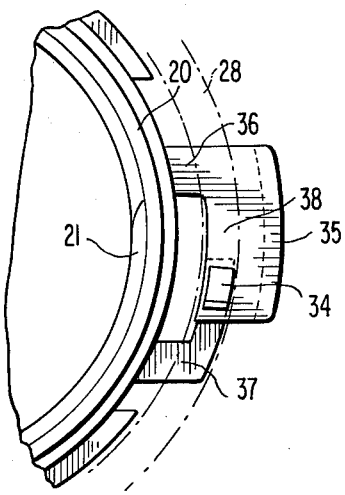
FIG.7
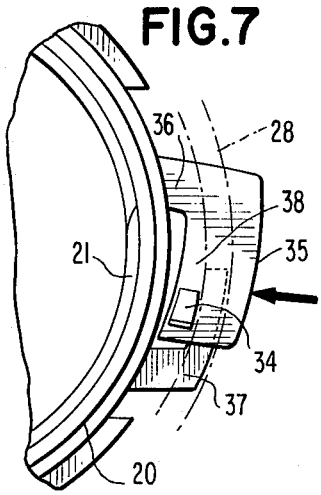

SAFETY CLOSURE FOR CONTAINERS

BACKGROUND OF THE INVENTION

Numerous safety closures for medicine and poison containers have been devised in the prior art for the protection of small children. Among the prior art types of safety closures are those which involve the ratcheting engagement of teeth on a container screw cap with a yielding locking element or tooth on the container neck or body portion, the container locking tooth responding to a downward manual pressure to effect release of the safety cap. Examples of such prior art type of cap are contained in U.S. Pat. Nos. 3,700,133; 3,884,379; 3,892,326; 3,902,620 and others.

It is also known in the prior art to provide a safety cap for containers in which a movable release element on the cap responds to lateral or side pressure to free the cap from interlocking engagement with teeth or other like projection means on the container.

The present invention is a departure from the prior art with the objective of providing a safety cap for containers which is simpler and more economical to manufacture, as by molding, which is easier and more convenient to manipulate with the fingers, without physical discomfort, and which is equally or more confusing to small children attempting to remove the cap, compared to the known prior art.

SUMMARY OF THE INVENTION

Essentially, the invention consists of a container body having a yielding resilient manually operable release element positioned on the side wall of the container near the end thereof which receives a screw-threaded cap. The release element carries a single upstanding locking tooth which is capable of ratcheting to interlocking engagement with a tooth on a bottom skirt member of the threaded cap during rotation of the cap to gradually tighten it down on the threaded portion of the container. The release element responds to pressure applied by the thumb at one side of the container to shift the tooth of the release element inwardly on a substantially radial path relative to the axis of the container and container cap. This movement separates the tooth of the release element from the locking tooth means of the threaded cap so that the cap may be removed by simple rotation. The arrangement presents a complex manipulation necessary to effect release of the cap which cannot be solved by small children.

The locking teeth on the container cap may be formed radially of the container or in the axial direction. A stop element may be provided on the container body to resist deflection or bending of the release element along the axis of the container.

The threaded container cap may, if desired, be a reversible cap having a plug portion to enter the mouth of the container.

The invention is applicable to both plastic and glass containers.

Other features and advantages of the invention will become apparent during the course of the following description.

BRIEF DESCRIPTION OF DRAWING FIGURES

FIG. 1 is an exploded perspective view of a safety closure and container combination showing the closure in an inverted position.

FIG. 2 is a side elevational view of the container and closure in assembled relationship and with the closure inverted from its position in FIG. 1 to a normal use position.

FIG. 3 is a side elevational view of the invention taken at right angles to FIG. 2 with the cap or closure in cross section.

FIG. 4 is an enlarged fragmentary vertical section through the container body enclosure taken on line 4—4 of FIG. 2.

FIG. 5 is a similar cross sectional view showing the side release element and locking tooth disengaged from the closure.

FIG. 6 is an enlarged fragmentary plan view of the container and release element and associated parts corresponding to FIG. 4, with portions of the closure shown in phantom lines.

FIG. 7 is a similar plan view of the same elements corresponding to FIG. 5.

DETAILED DESCRIPTION

Figure 10:
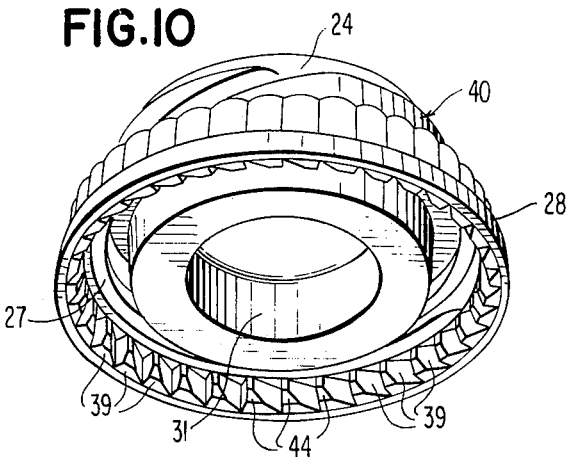
FIG. 10 is a perspective view of the container cap or closure in accordance with the modification depicted in FIGS. 8 and 9.
Figure 8:
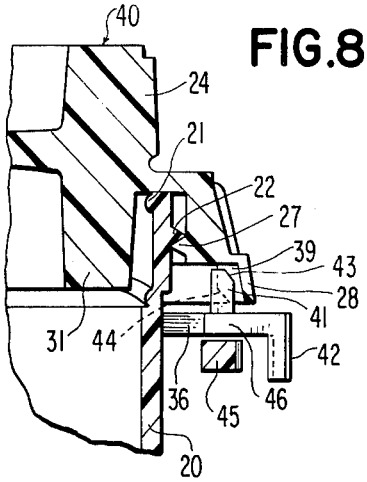
FIG. 8 is a fragmentary vertical section similar to FIG. 4 showing a modification of the invention.
Figure 11:
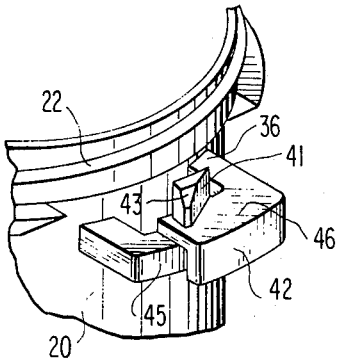
FIG. 11 is a fragmentary perspective view of the container and release element and associated parts in FIGS. 8 and 9 with the closure removed.
Figure 9:
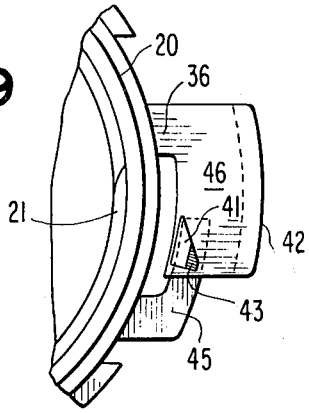
FIG. 9 is a fragmentary plan view similar to FIG. 6 showing the elements as positioned in FIG. 8.

Referring to the drawings in detail and referring first to FIGS. 1 through 7, wherein like numerals designate like parts, the numeral 20 designates a cylindrical container, such as a molded plastic container, having internal screw-threads 21 and external screw-threads 22 near its mouth.

The container 20 is adapted to receive a cap or closure 23 which is preferably of a reversible type although not necessarily so. As illustrated, the cap 23 has an externally screw-threaded cylindrical plug portion 24 adapted to enter the internally threaded mouth of the container 20 to plug the container when this mode of use is desirable.

The cap 23 additionally comprises an enlarged annular radial web 25 at the base of the plug portion 24 which forms a shoulder to limit the insertion of the plug portion into the mouth of the container. An annular side wall portion 26 of the cap concentric with the plug portion 24 and of considerably larger diameter is integrally joined to the web 25 and extends away from the web axially oppositely from the plug portion 24. The side wall portion 26 of the cap is internally screw-threaded at 27 for engagement with the external threads 22 of the container 20. When the cap is tightened on the container body, the bottom of the flat annular web 25 will abut the mouth of the container, as shown in FIG. 3.

The cap 23 includes a further enlarged annular skirt 28 at its end away from the plug portion 24 and within this skirt portion and below and radially outwardly of the screw-threads 27 are a multiplicity of circumferentially equidistantly spaced tapered ratchet-type teeth 29 whose side locking faces 30 extend radially of the cap and container. The cap 23 may include a non-functional ring portion or boss 31 concentric with and spaced inwardly of side wall portion 26 and adapted to enter the mouth of the container 20 in spaced relation to the internal screw-threads 21 when the cap is applied to the container in the manner shown in FIGS. 3 and 4 with the plug portion 24 uppermost.

The end face 32 of plug portion 24 may contain instructions for the release of the safety cap and the end face 33 of ring portion 31 may contain a warning to the effect that the cap is unsafe for children when the plug portion 24 is inserted in the mouth of container 20. Such indicia on the end faces 32 and 33 may be molded in the cap structure.

A single upstanding cooperating cap locking tooth 34 is integrally secured to the top face of a thumb-pressed yielding or deflectable release element 35 which is joined to the side wall of the container 20 near and below the external screw-threads 22 by a radial arm 36. As viewed from the top, FIGS. 1 and 6, the release element 35 is generally L-shaped and is spaced radially outwardly from the container side wall by the arm 36. The body of the release element 35 is also L-shaped in cross section as clearly shown in FIGS. 1 and 3. The release element 35 responds to thumb or finger pressure applied radially of the cap and container as shown by the arrows in FIGS. 5 and 7. Responsive to such radial or side pressure, the connecting arm 36 will bend and the release element 35 shifts radially inwardly to separate the single locking tooth 34 on the release element and container out of interlocking engagement with the particular ratchet locking tooth 29 of the screw-threaded rotary cap 23 which may happen to be engaged with the tooth 34 prior to release.

The teeth 29 and cooperating tooth 34 have corresponding sloping faces as shown clearly in FIG. 1 whereby during rotation of the cap 23 to tighten it on the container 20, the several teeth 29 will easily ratchet over the locking tooth 34. During such operation, the release element 35 will yield downwardly or axially on the container 20 to allow the necessary relative movement between the coating teeth 29 and 34. However, during the release operation, to free or unlock the safety cap 23, the release element 35 is shifted by thumb pressure in a radial or lateral direction, as previously described, and not downwardly or axially of the container.

To limit downward deflection of the release element 35 and bending of the arm 36, a stop tab 37 or element is secured fixedly to the side wall of container 20 sufficiently below the horizontal wall of the release element 35 to allow the ratcheting action of the teeth 29 and 34 but to preclude excessive downward deflection of the element 35 which could break the arm 36 in time. As shown in the drawings, the stop tab 37 directly underlies the horizontal wall 38 of release element 35 and is therefore in the path of its downward movement to positively limit such movement and to assure proper operation of the release element. As shown in FIGS. 4 and 5, the ratchet teeth 29 are spaced sufficiently far from the side wall of container 20 to allow full separation of the locking tooth 34 when the latter is shifted radially inwardly by thumb pressure.

While the operation of the safety cap structure should now be apparent from the above description, it may be briefly summarized as follows. The cap 23 or closure is applied to the container 20 and the threads 22 and 27 are engaged and the cap is rotated to gradually tighten it down on the container to the fully closed position of FIGS. 3 and 4. During such tightening rotation, the ratchet teeth 29 of the cap will readily trip over the locking tooth 34 of the container and the release element 35 will yield downwardly on the container, or in a general axial direction, to permit such ratcheting, and the stop tab 37 at all times will limit the downward deflection of the release element 35. The safety cap will be locked against normal rotational removal by a child through interengagement of the locking tooth 34 and one of the teeth 29 on the cap. In order to remove the cap from the container, the user must first press the release element 35 radially inwardly to fully separate the locking tooth 34 from the teeth 29 and while holding the release element in this position, FIGS. 5 and 7, the cap 23 must be rotated in the direction for separating the screw-threads 22 and 27.

FIGS. 8 through 11 show a modification of the invention differing from the form in FIGS. 1 through 7 mainly in that the circumferentially spaced ratchet teeth 39 of the modified cap or closure 40 extend parallel to the axis of the container 20 and cap rather than radially thereof, as with the teeth 29 of the prior embodiment.

Also in the modified form, the single locking tooth 41 on the top of radially movable release element 42 has a beveled upper corner 43 to coact with similarly beveled corners 44 of the cap ratchet teeth 39, whereby gradual downward movement of the threaded cap on the container 20 will bring the beveled corners 43 and 44 into contact tending to shift the locking tooth 41 radially inwardly on the container during the application of the cap rather than shifting it downwardly during the ratcheting action, as in the prior embodiment. This places less strain on the attaching arm 36 of the release element 42. A stop tab 45 for the same purpose as the tab 37 is provided on the container 20 below the release element 42 and this stop tab can be placed much closer to the bottom of the stop element top wall 46 due to the fact that the ratcheting action between the teeth 39 and 41 does not require significant downward movement of the tooth 41 and release element 42, as explained. Also, due to the axial disposition of the ratcheting teeth 39, as compared to the radial arrangement of the teeth 29, the locking tooth 41 and release element 42 will tend to move radially inwardly during the ratcheting action, rather than downwardly or axially of the container and the coacting slanting faces of the teeth 39 and single tooth 41, FIGS. 10 and 11, promote this mode of operation.

In all other respects, the construction of the container body 20 and safety cap are essentially the same as in the prior embodiment of the invention and those parts which have not changed have been identified with the same reference numerals in FIGS. 8 through 11. The same mode of operation is involved in the release and removal of the safety cap 40, namely, the forcing of the container mounted bendable release element 42 inwardly radially toward the side of the container the necessary distance to separate the teeth 41 and 39 from their locked position shown in FIG. 8, followed by rotation of the threaded cap in the proper direction.

Figure 12:
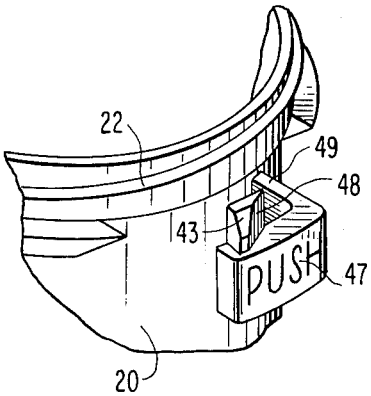
FIG. 12 is a similar perspective view showing a further modification.
Figure 13:
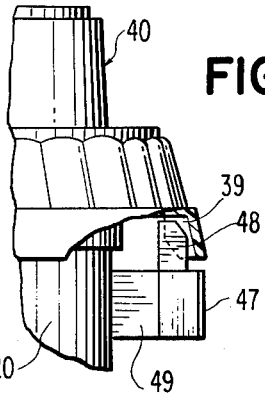
FIG. 13 is a fragmentary side elevation, partly in section, similar to FIG. 8 with the container closure in place showing the further modification.

FIGS. 12 and 13 show a small modification of the construction in FIGS. 8 through 11, wherein the stop tab 45 on the container 20 is eliminated and the radially deflecting release element 47 carrying single locking tooth 48 is made considerably thicker in the attaching arm portion 49 so as to be substantially non-bendable downwardly or along the axis of the container. This is in contrast to the thinner arm portion 36, previously described, which necessitated the use of a stop tab or element. All other parts are identical in construction and mode of operation to those shown and described in FIGS. 8 to 11.

Figure 14:
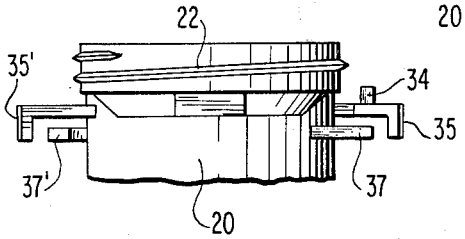
FIG. 14 is a fragmentary side elevation of a container and release means according to another modification.

FIG. 14 shows a variant or modification of the container 20 according to the first embodiment of FIGS. 1 to 7. In accordance with this variant, a dummy release element 35' without a locking tooth 34 and a dummy stop tab 37' are provided on the container 20 preferably diametrically opposite the elements 35 and 37 for the purpose of further confusing the child attempting to remove the locked safety cap 23. Only manipulation of the release element 35 can release the safety cap 23 in the embodiment of FIG. 14.

Figure 15:
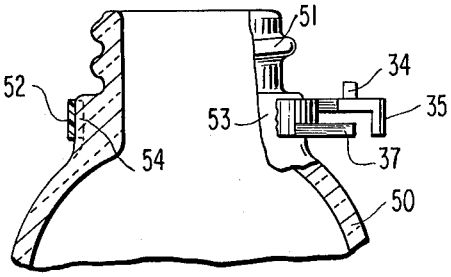
FIG. 15 is a fragmentary vertical section showing the invention adapted to a glass container.
Figure 16:
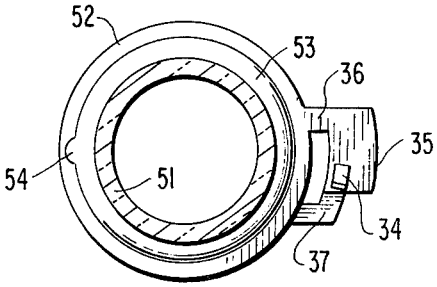
FIG. 16 is a plan view of the modification shown in FIG. 15, partly in section.

FIGS. 15 and 16 show another embodiment of the invention in accordance with FIGS. 1 through 7, but adapted for use on a glass container 50 or bottle having a threaded neck 51. In lieu of the elements 35 and 37 being attached directly to the container 20, in FIGS. 1 through 7, these same elements are attached to a plastic adapter ring 52 which surrounds an enlarged shoulder 53 on the container 50 immediately below the threaded neck 51 and is shrunk thereon tightly by known techniques. Additionally, a small keying projection 54 on the shoulder 53 serves to lock the ring or band 52 against rotation on the container. The mode of operation with respect to the safety cap, not shown in FIGS. 15 and 16, is identical to the mode of operation of the first embodiment.

Another variant of the invention not shown in the drawings is to form the male screw-threads which engage the safety cap on the shrink adapter or ring instead of on the neck of the container. In such a case, the shrink ring can be of much smaller diameter and can be slipped over and shrunk onto the threadless neck of a container similar to the one shown in FIG. 15. With this arrangement, the cap or closure can be of smaller diameter. These latter two modifications are applicable to all forms of the invention.

The invention in all of its embodiments is simple and economical, structurally sturdy and provides a new and improved mode of operation and one which is more convenient than prior art arrangements.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a container, a body portion having a threaded mouth, a screw closure for the container rotationally engageable with the threaded mouth and having a circumferentially extending group of locking teeth, and a release element on the side wall of said body portion having a part adapted to interlock with a tooth of said screw closure when the screw closure is applied to said threaded mouth of said body portion, said release element including a circumferentially extending spring-like bendable element spaced radially outwardly from the container side wall, a radially extending arm connecting an end of the release element to the container side wall, said release element movable laterally toward and away from said side wall and said part interlocking with said tooth and preventing rotational removal of said screw closure when the release element is in an outward position relative to said side wall, and said part separating from said tooth and releasing said screw closure for rotational removal when said release element is moved laterally to an inward position relative to said side wall.

2. In a container as defined by claim 1, said release element being positioned below the locking teeth of said screw closure, and said part of the release element comprising a single upstanding tooth on the release element and being spaced from said side wall.

3. In a container as defined by claim 2, and said teeth of the screw closure and said single tooth on the release element having coacting inclined faces allowing said teeth to ratchet over said single tooth during rotational application of the screw closure to the threaded mouth of the container body portion.

4. In a container as defined by claim 2, and said teeth of the circumferentially extending group being formed substantially radially of the container, whereby lateral inward movement of said single upstanding tooth on said release element will effect its separation from said teeth.

5. In a container, a body portion having a threaded mouth, a screw closure for the container rotationally engageable with the threaded mouth and having a circumferentially extending group of locking teeth, and a release element on the side wall of said body portion having a part adapted to interlock with a tooth of said screw closure when the screw closure is applied to said threaded mouth of said body portion, said release element movable toward and away from said side wall and said part interlocking with said tooth and preventing rotational removal of said screw closure when the release element is in an outward position relative to said side wall, said part separating from said tooth and releasing said screw closure for rotational removal when said release element is moved to an inward position relative to said side wall; said release element comprising a spring-like bendable element on said side wall below the locking teeth of said screw closure, said part of the release element comprising a single upstanding tooth on the release element and being spaced from said side wall; said teeth of the circumferentially extending group being formed substantially radially of the container, whereby substantially radial inward movement of said single upstanding tooth on said release element will effect its separation from said teeth, and a stationary stop element on said side wall below said release element to limit downward displacement of the release element and thereby preventing damage to the release element.

6. In a container, a body portion having a threaded mouth, a screw closure for the container rotationally engageable with the threaded mouth and having a circumferentially extending group of locking teeth, and a release element on the side wall of said body portion having a part adapted to interlock with a tooth of said screw closure when the screw closure is applied to said threaded mouth of said body portion, said release element movable toward and away from said side wall and said part interlocking with said tooth and preventing rotational removal of said screw closure when the release element is in an outward position relative to said side wall, said part separating from said tooth and releasing said screw closure for rotational removal when said release element is moved to an inward position relative to said side wall; said release element comprising a spring-like bendable element on said side wall below the locking teeth of said screw closure, and said part of the release element comprising a single upstanding tooth on the release element and being spaced from said side wall; and said teeth of the circumferentially extending group being formed in a substantially axial direction on said screw closure and having lower interior beveled corners, said single upstanding tooth on the release element having a cooperating top exterior beveled corner and said teeth and single upstanding tooth all having cooperating angled side faces which promote ratcheting action when said screw closure is being applied rotationally to said container body portion.

7. In a container as defined by claim 6, and a stop element on said side wall below said release element in close proximity to a bottom face of the release element so that no substantial deflection of the release element can occur on a path substantially axially of the container.

8. In a container as defined by claim 5, and at least one additional dummy release element and stationary stop element on said side wall and circumferentially spaced from said release element and stationary stop element.

9. In a container as defined by claim 1, and an adapter ring carrying said release element and attachable fixedly to a part of said container body portion.

10. In a container as defined by claim 9, and said adapter ring comprising a shrinkable ring adapted to be shrunk tightly onto an annular axial surface of a glass container body portion below a threaded neck of the glass container body portion.

11. In a container as defined by claim 10, and a stationary stop element on said adapter ring beneath said release element.

12. In a container as defined by claim 2, and said single upstanding tooth being disposed near the end of the release element body portion away from said arm whereby said single upstanding tooth moves in an arcuate path generally radially of said side wall responsive to generally radially applied pressure on the outer side of the release element.

13. In a container as defined by claim 2, and said screw closure having an interior end skirt spaced radially from said side wall, and said circumferentially extending group of teeth disposed on the interior of said skirt.

14. In a container as defined by claim 1, said threaded mouth of said body portion having exterior and internal screw-threads, said screw closure being reversible and having an externally threaded plug end portion adapted to rotationally enter said mouth, and said screw closure having internal threads on an opposite end portion engageable rotationally over said mouth with said plug end portion then extending exteriorly of and axially away from said mouth.

* * * * *